United States Patent [19]

Beveridge et al.

[11] 4,420,076

[45] Dec. 13, 1983

[54] MOISTURE RESISTANT, QUICK RELEASE PILL CONTAINER

[76] Inventors: Lois M. Beveridge, 303 Berts Dr., Lothian, Md. 20711; Harry LaCoste, Kenilworth Towers, Bladensburg, Md. 20710

[21] Appl. No.: 393,326

[22] Filed: Jun. 29, 1982

[51] Int. Cl.[3] ..... A45C 11/00; B65D 83/04; B65D 85/56; B65D 59/02

[52] U.S. Cl. ..... 206/37; 206/528; 206/540; 215/364; 220/352; 220/358

[58] Field of Search ..... 206/37, 38, 204; 215/364; 220/358, 352, 293

[56] References Cited

U.S. PATENT DOCUMENTS

| | | | |
|---|---|---|---|
| 2,701,659 | 2/1955 | Baltosser | 220/358 |
| 3,119,541 | 1/1964 | Lynn | 220/352 |
| 3,567,085 | 3/1971 | Flores | 206/204 |
| 4,108,325 | 8/1978 | Barre | 215/364 |
| 4,129,228 | 12/1978 | Stoneback | 220/293 |
| 4,333,562 | 6/1982 | Todd | 206/37 |

*Primary Examiner*—William T. Dixson, Jr.
*Attorney, Agent, or Firm*—Shoemaker and Mattare, Ltd.

[57] ABSTRACT

A pill container for wearing by a user requiring medicine which can be quickly and easily reached in in an emergency situation comprising a portion of the container wearable from the body of a user, another separable tubular portion for containing the actual medicinal pills therewithin, and gasket structure mounted on the insert member for the dual function of securely holding the separable cup-like compartment together with the suspended insert and also permitting quick separation thereof in an emergency as well as excluding moisture and other contaminants from any medicine contained within the removable cup-like portion.

19 Claims, 8 Drawing Figures

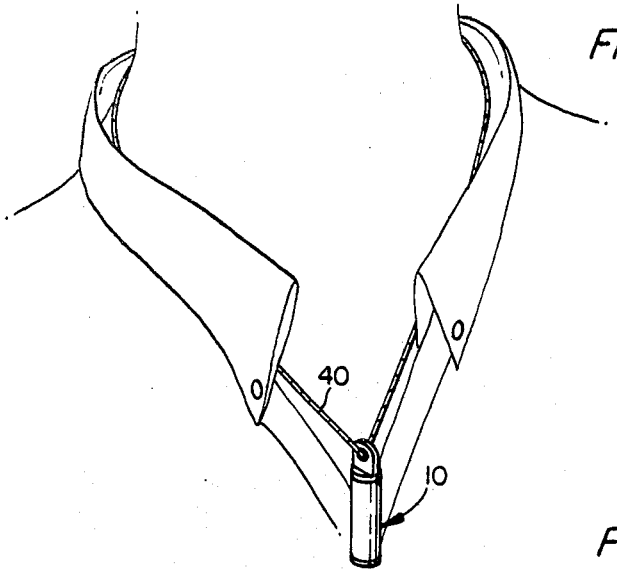
FIG. 1.
FIG. 2.
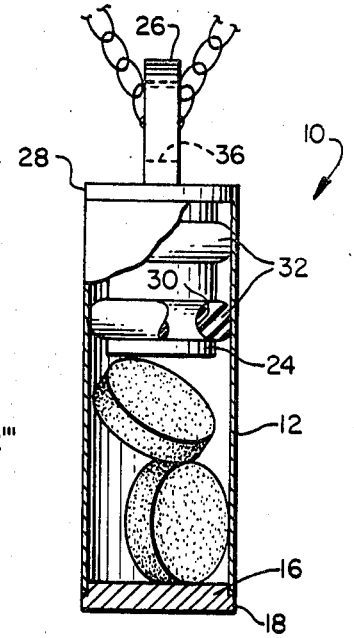
FIG. 4c.
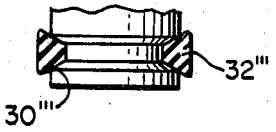
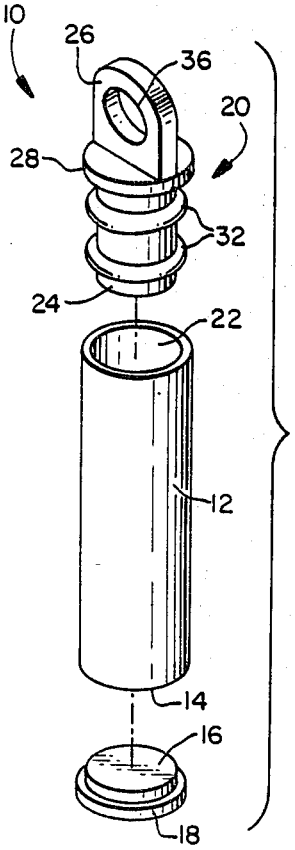
FIG. 3.
FIG. 4a.
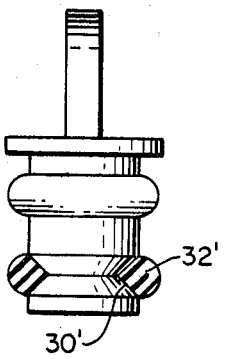
FIG. 4b.
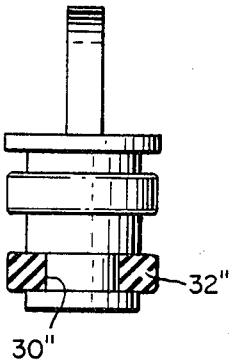
FIG. 5a.
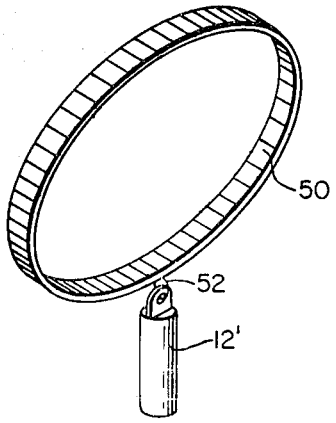
FIG. 5b.
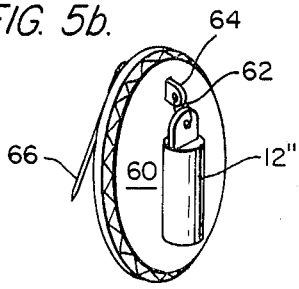

MOISTURE RESISTANT, QUICK RELEASE PILL CONTAINER

BACKGROUND OF INVENTION

1. Field of the Invention

This invention relates generally to devices for containing pills which must be kept free from outside contaminants such as moisture and yet be quickly and readily obtainable when a user of the device needs a pill.

2. Description of the Prior Art

A common problem with known pill containers of conventional type is that they do not adequately prevent contaminant such as moisture from reaching the pills contained therewithin, and thus when the pills are needed, they have either completely or partially deteriorated.

A further problem with known type device is that even if the container itself is contaminant free, in such cases they generally are so constructed, such as with screw threads or the like, so that it takes quite a bit of time to obtain a pill when needed. Therefore, in emergency situations where the user needs a pill within just seconds, such as in the case of a pending heart attack and using nitroglycerin tablets, delay caused by fumbling and attempting to open the pill container can be disastrous if not fatal. In addition, threads, especially fine threads, have been known to lock up. If this happens it may be impossible to remove the top of the pill container without completely destroying the entire assembly.

Locked threads can be caused by:

1. Closed with too much force, but usually can be opened with pliers.
2. A sliver of metal breaks loose from one of the mating threads and causes them to (gauld) bind up. Sometimes in such a case even 2 pairs of pliers will not separate the mating pieces.

There have been devices devised to hold pills in contaminant free manner, but often times these devices still are far from effective. Similarly, structures for holding the pills contaminant free and yet providing quick ready access thereto in the known type devices leave much to be desired.

Existing prior patents which may be pertinent to this invention are as follows:

J. N. Moehn, U.S. Pat. No. 567,488, Sept. 8, 1896
J. F. Foley, U.S. Pat. No. 1,446,894, Feb. 27, 1923
R. B. Waite, U.S. Pat. No. 1,509,916, Sept. 30, 1924
E. K. Lefren, U.S. Pat. No. 2,428,884, Oct. 14, 1947
James G. Flores, U.S. Pat. No. 3,567,085, Mar. 2, 1971

These patents generally show containers for holding pills or tablets.

The patent to Moehn, U.S. Pat. No. 567,488, discloses a vial for soluble tablets wherein a cork closes the vial and a pressure spring D together with soft pad E prevent the tablets from moving within the vial. However, no convenient structure for attachment of the vial to a person is provided, nor is the device designed for quick use in case of an emergency.

The patent to Foley, U.S. Pat. No. 1,446,894, discloses a container somewhat similar to subject invention, wherein medicinal powder can be quickly dispensed therefrom. However, holes 2 are provided at the lower end of the necklace suspended capsule, and a slidable sleeve 10, which functions as a valve to cover or uncover the holes 2, is employed. While the upper cut 4 is removable to replenish the medicinal powder within the capsule, the design is not for the purpose of permitting a user to quickly obtain tablets, such as the nitroglycerin tablets, as is the container of the present invention.

The Waite patent, U.S. Pat. No. 1,509,916, discloses another container for holding tablets for medicinal uses. In this case the method or preserving the contents is what is claimed and involves withdrawing all of the air and inherent moisture from the vial filled with tablets. This patent does not anticipate not render obvious the subject invention of this application.

The patent to Lefren, U.S. Pat. No. 2,428,884, is not for a pill container, but shows a tension structure for an electric blasting cap including a plurality of fins 7 extending from a plug 4. These fins provide a locking effect of the cap ignition structure with the casing 2 containing the explosive material. Of course, a moisture proof seal is obtained, but since the ribs are deformed as shown in FIG. 2, they tend to prevent separation of the two portions, and thus they obviously would defeat the quick release purpose of the present invention if used in a pill capsule.

The Flores patent, U.S. Pat. No. 3,567,085, discloses a necklace suspended container for holding medicinal pills in a moisture free environment, however, a subcompartment for holding a desiccant is required. Furthermore, the separable portions are screwed together, thus negating any quick release and separation thereof.

SUMMARY OF THE INVENTION

An object of the present invention is to provide a quick release, moisture resistant, pill container which can be worn by a person needing medicinal pills or tablets very, very quickly in the case of an emergency.

Another object of the present invention is to provide an easily attached device for wearing by a person in the case of an emergency who needs to obtain a pill as quickly as possible comprising a two-part container secured together by resilient gasket rings which not only permit quick release and the attachment of the two portions of the container, but also are moisture resistant to prevent contamination of the pills held within a container.

A further object of this invention is to provide a pill container device which can be easily and conveniently worn by a person, such as by a necklace, bracelet, pin or broach, and the like and with the attachment structure permitting the pill container of the present invention to be suspended in such a manner that the two-part structure can be very quickly and easily separated to reach a pill or pills contained therewithin.

A still further object of the present invention is to provide a pill container that can be used with various types of attachment structures for wearing by a user of medicinal pills with such attachment structure permitting the pill container to hang in suspended fashion from the person, and in addition, permit the person to quickly grasp and pull away the lower portion of this suspended container having the actual pills therewithin.

Another object of the present invention is to provide a pill container which is not only functional in use but also attractive in appearance (it may be of precious metal, i.e. gold, silver, etc.) and which when worn by a person will simulate somewhat attractive jewelry. Thus, a person wearing same can avoid any stigma attached thereto of someone that is ill or under treatment.

Many people have a need to have medication on their person at all times for activities of daily living, for recreation, and for sports. The neck supported pill container affords one the opportunity to go about these activities without the added psychological stress of keeping medication within reach. The device can quickly be separated with one hand if necessary. It is wide enough with adequate room on either side so that pills can be easily dispensed and long enough to hold an adequate supply.

Nitroglycerin tablets in a glass container, once opened and the cotton removed, are constantly being moved about in one's purse and/or pocket which results in breakage and disintergration of the tablets.

With the top design as shown the present device can be neck-supported, be placed on a bracelet, a key chain, or pinned to clothing.

The present invention has a number of new and novel features. The pill container of the present invention is designed to be worn by a user of medicinal pills or tablets, and when worn will appear as attractive jewelry. Several different structural arrangements for suspending the pill container of the present invention from a person's body or article of clothing are shown. For example, the device may be worn around the neck of the person, or may be worn suspended from a bracelet on a person's wrist, or may be attached to a person's jacket, sweater, shirt, blouse or alike by means of a regular type safety pin or a broach pin clamp or other fancier pin or clamp structure. It is important that the device be suspended so that the full benefits of the present invention, that is the quick release and separation of the two-part container, take place for emergency obtaining of the pills or other medicinal material contained therewithin. While pills and tablets are the preferred type materials, obviously powders and small capsules, etc. can be contained. Also the container can be made in various sizes to accommodate larger pills than those of the nitroglycerin size. While specifically designed for nitroglycerin tablets, this container can find use in many other applications.

A very important feature of the present invention is in the fact that the gasket ring structure which firmly and securely holds the two-part container together not only functions to retain the container together but also functions to prevent moisture and other contaminants from reaching the pills held therewithin. In fact, the moisture resistant benefits are sufficiently great that no desiccant type material is required to normally be used with the nitroglycerin tablets. However, of course if the type of pill being held is more susceptible to deterioration from moisture than nitroglycerin tablets, then a separate capsule containing a desiccant could be loosely suspended within the container. However, the inventors, one of whom is a nurse, does not envision this invention to normally be used in this fashion.

Another important feature of the present invention is that the pill container is quite attractive and when suspended from a necklace, bracelet, broach or other pin or clamping structure can function as pleasing and fashionable jewelry as well as for the utilitarian function described.

These together with other objects and advantages which will become subsequently apparent reside in the details of construction and operation as more fully hereinafter described and claimed reference being had to the accompanying drawings forming a part hereof, wherein like numerals refer to like parts throughout.

BRIEF DESCRIPTION OF THE DRAWINGS

FIG. 1 is a perspective view of the pill container of the present invention as suspended from a necklace around the neck of a user;

FIG. 2 is an enlarged side elevational view of the pill container of the present invention;

FIG. 3 is an exploded perspective view of the various components of the pill container of the present invention; and FIGS. 4*a*, 4*b* and 4*c* show various gasket ring embodiments; and FIGS. 5*a* and 5*b* show various other person wearable suspension and attachments structures for use with the pill container of the present invention.

DESCRIPTION OF THE PREFERRED EMBODIMENT

Referring to FIG. 1 of the drawing, reference numeral 10 indicates in general the pill container of the present invention. This device is shown in FIG. 1 as being worn and suspended from the neck of a user thereof. Of the necklace 40 shown in this Figure is one very good way of making the pill container readily accessible for either a man or a woman user, other structures for suspending and wearing the pill container are envisioned as depicted in FIG. 4 of the drawing.

The pill container of the present invention can best be seen in the exposed form of FIG. 3. A main body member 12 of tubular shaped forms the primary portion of the container. Appropriately, and securely mounted within the open end 14 of tubular member 12 is a plug 16 having an enlarged flange 18. Preferably the flange 18 has an outer circumference closing matching the outer circumference of tubular member 12. However, if desired, and in order to increase a user's grip on the smooth finished tubular member, the flange may be enlarged, so that additional grasp structure is provided for the user. With the plug 16 securely installed, the container portion of the pill holder is completed. Then pills, such as nitroglycerin pills, can now be held in this portion. The secondary portion of the pill container of the present invention is the insert 24 which has an outer diameter somewhat smaller than the internal diameter of the tubular member 12. An upper flange 28 preferably of the same diameter as that of the lower flange 18 prevents the insert 24 from being inserted completely inside tubular number 12. The tubular insert 24 also is provided with at least two circumferential grooves 30 for receiving gasket rings 32 therewithin. These gasket rings 32 firmly seat within the grooves 30 and have an outer circumference and diameter greater than the internal circumference and diameter of tubular member 12. Thus when the insert 24 is pushed into tubular member 12 at end 22, the insert 24 will be firmly and securely retained therewith. Also the flexible gasket rings 32 will provide a moisture resistant and contaminant resistant barrier to prevent any such contaminants from reaching pills within the primary container.

While as shown in FIGS. 2 and 3 of the drawings, the grooves 30 are semicircular in cross-section for closely receiving the gasket rings 32, which in cross-section are of "O" or circular shape, other type and shape grooves may be used such as combination V and semi-round shape 32, square or rectangular-shaped 32'', trapezoid-shaped 32'', with correspondingly shaped grooves, 30', 30″, and 30‴. These aternative shapes are shown in the embodiments of FIGS. 5*a, b,* and *c.*

Extending from the insert 24 on the other side of flange 28 is a projection 26. A hole 36 is provided in projection 26. This hole should be a sufficient internal diameter to readily permit fairly good size and strong necklaces, bracelets, pins, etc. to pass easily therethrough. Obviously, since this device can be very, very important in an emergency situation, such as an imminent heart attack, the use thereof with a weak chain or necklace would perhaps be disastrous. Therefore at all times, the structure used with the pill container for attaching same to a person's body or outer clothing should be quite strong and positive in action and function.

FIG. 5*a* shows a bracelet embodiment wherein a pill container 12′ similar to that already described is suspended from a bracelet 50 by means of a small link or loop 52 securely fastened to bracelet 50. FIG. 5*b* shows a broach 60 having a projection 64 for securement of ring or loop 62 for holding a pill container 12″. Of course the attaching pin 66 permits the broach 60 to be securely attached to a sweater, blouse, dress, suit or other garment being worn by the person using subject invention.

Of course, the pill container is preferably made of smooth polished and finished metal which should be corrosion resistant, stainless steel, or chrome plated steel, etc. or can be either silver or gold plated to greatly enhance the appearance and value thereof. However, in order to reduce the cost of this container to the lowest point possible and thus make it more readily available to the masses, the device can obviously be formed or molded of plastic material or the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A nitroglycerin pill holding device for quick, emergency use to permit a user easy, ready access to the pills almost immediately when indications of a pending heart attack occur comprising:

a primary part comprising a cup-like container having an open end with an inner circumference of a predetermined size;

a secondary part comprising an insert having an outer circumference of smaller size than said container inner circumference, and slidable relatively loosely into the open end of said cup-like container;

means mounted on said insert for filling the gap between the outer circumference of the insert and the inner circumference of the cup-like container with the dual function of securing the primary and secondary parts securely together and yet rendering them quickly and easily separable by a simple longitudinal pull and also as contaminant excluding structure for protecting pills held within the container.

2. A device as set forth in claim 1, together wth an extension provided on the slidable insert for receiving suspension structure therethrough, and user wearable means connected to said extension for attaching and suspending said device from a user of the device.

3. A device as set forth in claim 2, wherein said wearable means includes a necklace for wearing about the neck of a user.

4. A device as set forth in claim 2, wherein said wearable means includes a bracelet for wearing about the wrist of a user.

5. A device as set forth in claim 2, wherein said wearable means includes a pin on type structure, and means for attaching and suspending said device from a user of the device.

6. A device as set forth in claim 2, wherein said means for performing the dual function of holding the primary and secondary parts together and also excluding contaminants from the pills includes a pair of spaced circumferential grooves around the circumference of the insert and a gasket O-ring of flexible material in each of said grooves.

7. A device as set forth in claim 6, wherein each of said pair of grooves is of semicircular shape and each said gasket O-ring is of circular shape in cross section.

8. A device as set forth in claim 6, wherein each of said pair of grooves is of V-shape and each said gasket O-ring is of V shape in cross-section.

9. A device as set forth in claim 6, wherein each of said pair of grooves is of rectangular shape and each said gasket O-ring is of rectangular shape in cross-section.

10. A device as set forth in claim 6, wherein each of said pair of grooves is of wedge shape and each said gasket O-ring is of a complementary rhomboid shape in cross-section.

11. A person wearable pill container comprising: an elongated tubular member having one end thereof securely closed so that said tubular member only has one end open, an insert member slidably fittable loosely into the said open end of the tubular member, and dual purpose gasket means with the insert member for providing quickly releasable and yet secured attachment of said two members together and also providing moisture and contaminant exclusion for any medicinal material contained within the elongated tubular member.

12. A device as set forth in claim 11, wherein said dual purpose gasket means includes at least two separate and distinct gasket structures mounted on said insert member spaced distance apart for greatly increasing the effectiveness of said means and the strength, stability, and operating effectiveness thereof.

13. A device as set forth in claim 12, wherein said dual purpose gasket means further includes additional means for suspending said device from a user so that the portion which is separable from the insert can be very quickly completely removed by a simple pull and handled even by third parties without interfering with the suspension means for the insert member of the device.

14. A pill container for wearing by a user which can be easily and quickly opened during an emergency comprising: a tubular member having only one open end for holding medicinal pills therewithin, said tubular member having a predetermined internal circumference, an insert of external circumference substantially less than the internal circumference of said tubular member so that the insert can be slid loosely into the single open end of the tubular member, a pair of ring-like gaskets mounted in a pair of spaced complementary grooves within the outer circumference of said insert for performing the dual function of filling the space between the insert and the tubular member for holding them securely together and still permitting slidable separation of the two for easy access by a user to medicinal pills within said tubular member and also providing contamination excluding protection for the medicinal pills when the insert and the tubular member are together.

15. A device as set forth in claim 14, wherein each of said complementary grooves is V-shaped and each of said gaskets is similarly shaped in cross-section at the groove engaging portion thereof.

16. A device as set forth in claim 14, wherein each of said grooves is of wedge shape and each of said gaskets is of complementary trapezoidal shape in cross-section at the groove engaging portion thereof.

17. A device as set forth in claim 14, wherein each of said grooves is of rectangular shape and each of said gaskets is of complementary rectangular shape in cross-section at the groove engaging portion thereof.

18. A device as set forth in claim 14, said insert further including means for permitting attachment of said device to a user thereof.

19. A device as set forth in claim 18, wherein said means wearable by a user is an element selected from the group consisting of a necklace, a bracelet, and a pin-on brooch.

* * * * *